US006425336B1

(12) United States Patent
Brennwald

(10) Patent No.: US 6,425,336 B1
(45) Date of Patent: Jul. 30, 2002

(54) GRATE TROUGH AS PART OF A GRATE FOR A PLANT FOR THE THERMAL TREATMENT OF WASTE

(75) Inventor: Werner Brennwald, Neftenbach (CH)

(73) Assignee: Von Roll Umwelttechnik AG, Zürich (CH)

( * ) Notice: Subject to any disclaimer, the term of this patent is extended or adjusted under 35 U.S.C. 154(b) by 0 days.

(21) Appl. No.: 09/858,729

(22) Filed: May 16, 2001

(30) Foreign Application Priority Data

Oct. 25, 2000 (CH) ..... 2000 2087/00

(51) Int. Cl.[7] ..... F23K 3/08; F23H 13/00; B21D 39/03

(52) U.S. Cl. ..... 110/268; 126/152 B; 29/428

(58) Field of Search ..... 126/152 B, 152 R; 110/270, 281, 282, 283, 294, 165 R, 166, 167, 168, 169, 165 A; 29/464, 465, 21.1, 33.13 B, DIG. 48, 428, 437, 890.549, 890.03

(56) References Cited

U.S. PATENT DOCUMENTS

| | | | | | |
|---|---|---|---|---|---|
| 527,449 | A | * | 10/1894 | Richards | 110/165 A |
| 1,149,702 | A | * | 8/1915 | Vail | 29/DIG. 48 |
| 1,518,024 | A | * | 12/1924 | Urquhart | 126/152 B |
| 1,655,947 | A | * | 1/1928 | Gallowitz | 29/DIG. 48 |
| 1,786,358 | A | * | 12/1930 | Milner | 126/152 B |
| 1,973,591 | A | * | 9/1934 | Weber | 29/DIG. 48 |
| 1,977,678 | A | * | 10/1934 | Kidd | 29/DIG. 48 |
| 2,341,980 | A | * | 2/1944 | Dalen | 110/30 |
| 2,388,297 | A | * | 11/1945 | Slaughter | 29/DIG. 48 |
| 3,295,598 | A | * | 1/1967 | Metzger | 165/172 |
| 3,871,287 | A | | 3/1975 | Spillman et al. | |
| 4,170,183 | A | * | 10/1979 | Cross | 110/268 |
| 4,258,692 | A | * | 3/1981 | Mackey | 126/60 |
| 4,320,710 | A | * | 3/1982 | Steiner et al. | 110/281 |
| 4,765,256 | A | * | 8/1988 | Caughey | 110/229 |
| 5,377,663 | A | | 1/1995 | Cole et al. | |
| 5,528,992 | A | | 6/1996 | Cole | |
| 5,617,801 | A | | 4/1997 | Hauser et al. | |
| 5,713,345 | A | * | 2/1998 | Bentsen et al. | 126/152 B |
| 6,024,031 | A | * | 2/2000 | Stiefel | 110/281 |

FOREIGN PATENT DOCUMENTS

| | | | | |
|---|---|---|---|---|
| CH | 0713056 | * | 5/1996 | F23H/3/02 |
| DE | 43 35 085 | | 6/1995 | |
| EP | 713 056 | | 5/1996 | |
| GB | 884 190 | | 12/1961 | |

* cited by examiner

*Primary Examiner*—Ira S. Lazarus
*Assistant Examiner*—K. B. Rinehart
(74) *Attorney, Agent, or Firm*—Cohen, Pontani, Lieberman & Pavane

(57) ABSTRACT

A grate trough forms the lower part of a grate element which has a plurality of fixed and a plurality of movable grate block rows. The grate block rows each include a plurality of grate blocks suspended next to one another on a block holding element and connected firmly to one another. The grate trough forms a carrying element for the block holding tubes of the fixed grate block rows and support for a movable grate carriage carrying the block holding elements of the movable grate block rows. The grate trough has two side walls and also a front and a rear frontal wall, the frontal walls being arranged at right angles to the side walls. The side walls and the frontal walls are provided at their junction with projections and recesses which engage one into the other, with the result that the walls are held in an exact position. The length and width of the grate trough remain constant, even after welding, since the walls cannot be displaced relative to one another. The weld seam distortion and weld seam stress are minimized due to the offset of the weld seam lines. The mounting of the grate element becomes appreciably simpler.

5 Claims, 3 Drawing Sheets

GRATE TROUGH AS PART OF A GRATE FOR A PLANT FOR THE THERMAL TREATMENT OF WASTE

BACKGROUND OF THE INVENTION

BACKGROUND OF THE INVENTION

The invention relates to a grate trough as part of a grate for a plant for the thermal treatment of waste.

As is known, for example, from EP-B-0 713 056, a grate has a plurality of, as a rule three to five, grate elements which are arranged one behind the other and each comprise a plurality of grate block rows arranged one behind the other in a stairlike manner. A fixed grate block row is followed in each case by a movable grate block row which exerts a pushing and shearing action on the waste material located on the grate. Each grate block row is formed by a plurality of grate blocks which are suspended next to one another on a block holding tube and which are firmly connected to one another. The block holding tubes of the movable grate block rows are carried by brackets which are fastened on a movable grate carriage. Brackets, which are mounted on a fixed block, are also provided for the block holding tubes of the fixed grate block rows. This block is connected to side walls of a grate trough which forms the lower part of the respective grate element. The movable grate carriage is also supported on the side walls. A front and a rear frontal wall are arranged at right angles to the side walls of the grate trough and are welded to the side walls. The adjacent frontal walls of individual grate elements are screwed to one another. For an exact alignment of the block holding tubes, an exact arrangement of the brackets and of the supporting surfaces for the grate carriage is indispensable. The walls of the grate trough must be aligned exactly with one another. After the wall edges butting on one another have been welded together, the adverse effects of the weld seam distortion must be rectified, the block or its bearing surface for the brackets must be oriented exactly and the brackets must be positioned and welded on accurately.

SUMMARY OF THE INVENTION

The object of the present invention is to provide a grate trough which is simple and cost-effective in terms of production and which makes it possible to mount the grate element in a simple way.

Pursuant to this object, and others which will become apparent hereafter, one aspect of the present invention resides in a grate trough as part of a grate element for a grate which is provided for a plant for thermal treatment of waste, which grate has a plurality of grate elements arranged behind one another. Each grate element comprises a plurality of fixed and a plurality of movable grate block rows which are arranged so as to follow one another alternately and which are formed in each case from a plurality of grate blocks suspended next to one another on a block holding element and connected firmly to one another. The grate trough forms a carrying element for the block holding elements of the fixed grate block rows and support for a movable grate carriage carrying the block holding elements of the movable grate block rows. The grate trough comprises sidewalls extending in a longitudinal direction of the grate and a front and rear frontal wall. The frontal walls are welded to the sidewalls so as to be at right angles to the sidewalls. The sidewalls and the frontal walls have projections and recesses which engage into one another.

Since the frontal walls and the side walls have at their junction projections and recesses which engage one into the other, the grate trough walls are arranged and welded together in an exact position relative to one another, without the walls being capable of being displaced relative to one another. The length and width of the grate trough remains constant. The weld seam lines extending along the wall edges are offset relative to one another as a result of the projections and recesses engaging one into the other, with the result that the weld seam distortion and the weld seam stress are minimized. No additional work is necessary for aligning the grate trough walls or additional parts carrying the block holding tubes. The block holding tubes for the fixed grate block rows can be arranged directly in recesses of the side walls.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
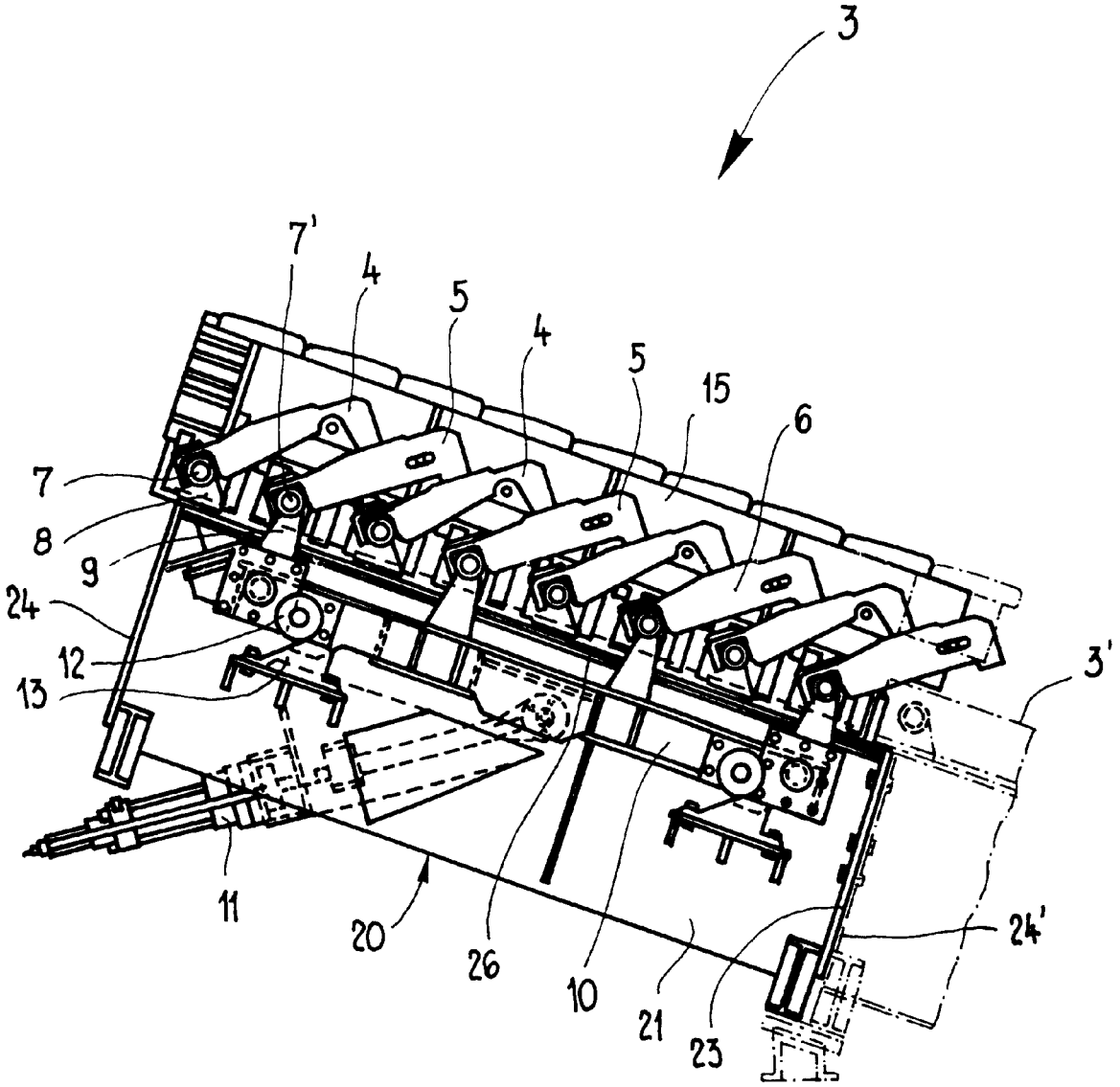
FIG. 1 shows an exemplary embodiment of a grate element as part of a grate according to the prior art.

FIG. 1 shows a grate element 3, known per se, as part of a grate for a plant for the thermal treatment of waste. An inclined grate track is composed longitudinally of a plurality of grate elements 3 (a further grate element 3' is indicated by dashes and dots in FIG. 1). As a rule, three to five grate elements 3 are arranged one behind the other. A plurality of grate tracks may be arranged next to one another and together determine the grate width; one to four grate tracks are normally used.

Each grate element 3 has a plurality of, if appropriate eight, grate block rows 4, 5 arranged one behind the other in a stairlike manner, in each case a fixed grate block row 4 being followed by a movable grate block row 5. A plurality of grate blocks 6 are arranged next to one another in each grate block row 4, 5. The grate blocks 6 of a grate block row 4 or 5 are in each case suspended on a block holding tube 7 or 7' and firmly connected, preferably screwed, to one another. Instead of the block holding tubes 7, 7' illustrated, however, other barlike or tubular block holding elements of different profile could also be used.

The block holding tubes 7 of the fixed grate block rows 4 are carried by fixed brackets 8 connected to a grate trough 20. The grate trough 20, which forms the lower part of the grate element 3, has two side walls 21 and also a front and a rear frontal wall 23, 24. The side walls 21 are in each case connected to a beam 26, on which the brackets 8 are arranged and fastened (preferably welded). The front and the rear frontal wall 23, 24 are arranged at right angles to the side walls 21. The adjacent frontal walls of the grate elements 3, 3' arranged one behind the other are connected, preferably screwed, to one another (in the exemplary embodiment illustrated in FIG. 1, the front frontal wall 23 of the first grate element 3 is screwed to the rear frontal wall 24' of the following grate element 3').

The block holding tubes 7' of the movable grate block rows 5 are carried by brackets 9 which are mounted on a movable grate carriage 10. The grate carriage 10 is driven by means of two hydraulic cylinders 11 arranged in parallel and at the same time are moved back and forth on running surfaces 13 via rollers 12. The movable grate block rows 5 are also moved at the same time and exert a pushing and shearing action on the waste material located on the grate track, so that new waste surfaces are repeatedly exposed to thermal treatment in the furnace chamber, the waste material simultaneously being conveyed forward.

The grate carriage 10 together with the brackets 9 and with the block holding tubes 7' is arranged within the grate trough 20 and is supported on the side walls 21 of the trough 20.

Figure 2:
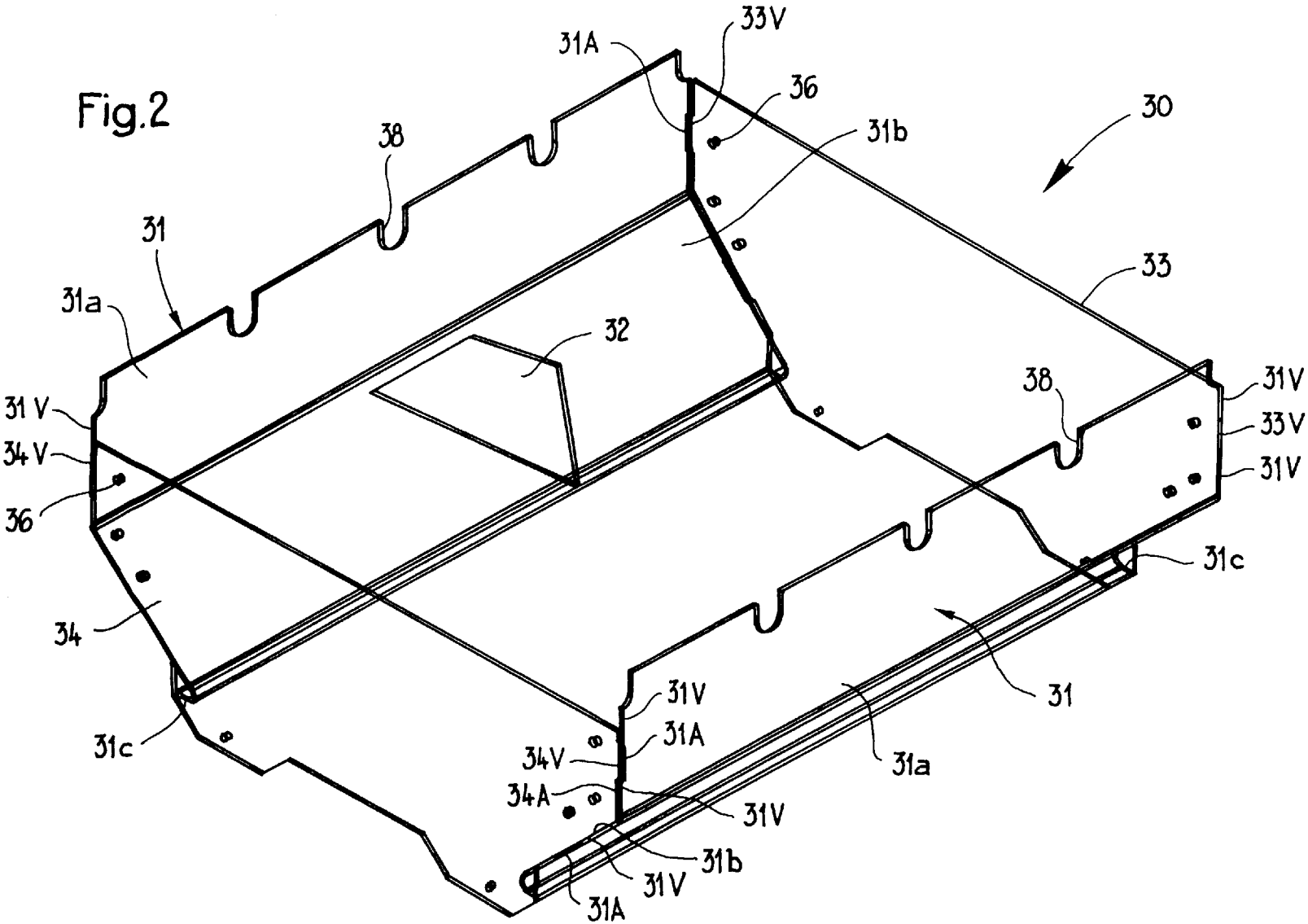
FIG. 2 shows a perspective illustration of a grate trough according to the invention for a grate element.
Figure 3:
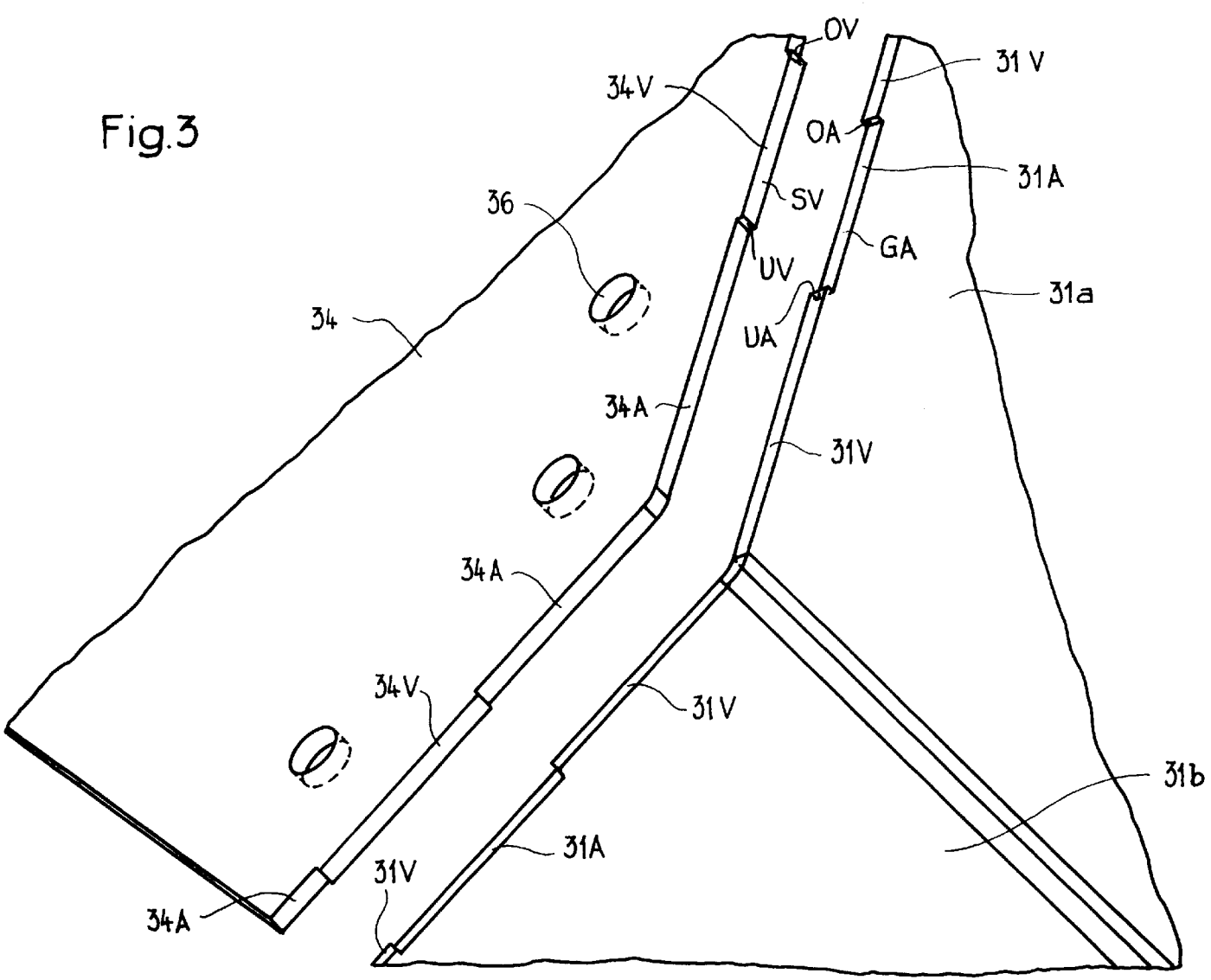
FIG. 3 shows wall edges of two mutually assigned wall parts of the grate trough according to FIG. 2, separated from one another.

An exemplary embodiment of a grate trough 30 according to the invention is described below with reference to FIGS. 2 and 3. The grate trough 30 corresponds in function to the grate trough 20 according to FIG. 1, that is to say it forms a carrying element for the immovable grate block rows 4 or their block holding tubes 7 and support for the grate carriage 10. For clearer understanding, the walls are illustrated as consisting of a transparent material, but are manufactured from sheet metal.

The grate trough 30 comprises two mirror-symmetrically designed side walls 31 which are located opposite one another and each have an upper, vertically running wall part 31*a,* a middle wall part 31*b* and a lower, outwardly bent wall part 31*c* (a reinforcement). The two middle wall parts 31*b* converge downward and have, approximately in the middle of their length, a quadrangular orifice 32 provided for connecting the hydraulic cylinders 11, known from FIG. 1 and arranged laterally of the grate trough 30, to the grate carriage 10 accommodated within the grate trough 30 and supported in a way not illustrated in any more detail on the middle wall parts 31*b*.

A front frontal wall 33 and a rear frontal wall 34 are arranged at right angles to the side walls 31. Both frontal walls 33, 34 have connecting holes 36 which are provided for connecting, preferably screwing, the grate troughs 30 of adjacent grate elements 3.

The frontal walls 33, 34 and the side walls 31 are equipped at their junction with projections 33V, 34V, 31V and recesses 33A, 34A, 31A which engage one into the other. There is a plurality of such projections 33V, 34V, 31V and recesses 33A, 34A, 31A along the connecting edge between the respective frontal wall 33 or 34 and the respective side wall 31.

In the exemplary embodiment illustrated, each grate wall has toothlike projections and recesses in the wall edge at the point of connection to the other wall. In this case, the projections of one wall engage laterally into the corresponding recesses of the other wall arranged at right angles, so that in each case a side face of the projection comes to bear on a bottom face of the recess. FIG. 3 shows a partial illustration of two wall edges provided for connection, if appropriate the wall edge of the side wall 31 or of its wall parts 31*a,* 31*b* and the wall edge of the rear frontal wall 34. In FIG. 3, SV designates a side face of one of the projections 34V and GA designates the corresponding counterface or bottom face of the recess 31A, said faces coming to bear when the frontal wall 34 is assembled together with the side wall 31. The upper face OV and the lower face UV of the projection 34V, which are arranged transversely to the run of the wall edge of the frontal wall 34, at the same time come into bearing contact with the upper face OA and with the lower face UA of the recess 31A. In a similar way, the remaining projections 31V, 34V of these two walls 31, 34 also engage into the associated recesses 34A, 31A, and, in the same way, the projections and recesses of the wall edges are also in engagement in the other three corner regions of the grate trough 30. The individual walls 31, 33, 34 of the grate trough 30 are thereby brought into an exact position relative to one another, before being welded together, and the length and width of the grate trough 30 is thus fixed. This length and width remains constant, since the walls cannot be displaced relative to one another. The weld seam lines extending along the wall edges are offset relative to one another as a result of the projections and recesses engaging one into the other, the weld seam distortion and the weld seam stress thereby being minimized.

Instead of the toothlike projections and recesses, illustrated, in the respective wall edge, a different shape and arrangement of the projections and recesses engaging one into the other could also be envisaged, but the embodiment illustrated and described is particularly simple. The wall edge shape necessary can be cut out exactly from the metal wall sheet, for example by means of a laser.

Since, according to the invention, the permissible tolerances in the setting of the grate trough walls relative to one another can be achieved without any additional work, the block holding tubes 7 for the immovable grate rows 4 can be carried directly by the side walls 31 of the grate trough 30. For this purpose, according to FIG. 2, the side walls 31 are provided with groovelike recesses 38 distributed uniformly over the grate trough length. The use of brackets, which must be arranged on an exactly oriented block and be fastened in exact positions, is dispensed with. The production and assembly costs of a grate element having the grate trough 30 according to the invention are reduced considerably.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

I claim:

1. A grate element, comprising: a plurality of fixed and a plurality of movable grate block rows which are arranged so as to follow one another alternately and which are formed in each case from a plurality of grate blocks suspended next to one another on a block holding element and connected firmly to one another; and a grate trough forming a carrying element for the block holding elements of the fixed grate block rows and support for a movable grate carriage carrying the block holding elements of the movable grate block rows, the grate trough comprising two side walls extending in a longitudinal direction of the grate, and a front and a rear frontal wall, the frontal walls being welded to the side walls so as to be at right angles to the side walls, the side walls and the frontal walls having projections and recesses which engage one into one another, the projections and recesses are provided in an edge of each wall so that projections of one wall project laterally into the recesses of another wall arranged at right angles so as to in each case bear with a side face on a bottom face of the corresponding recess.

2. A grate trough as part of a grate element for a grate which is provided for a plant for thermal treatment of waste and has a plurality of grate elements arranged behind one another, each grate element comprising a plurality of fixed and a plurality of movable grate block rows which are arranged so as to follow one another alternately and which are formed in each case from a plurality of grate blocks suspended next to one another on a block holding element and connected firmly to one another, the grate trough forming a carrying element for the block holding elements of the fixed grate block rows and support for a movable grate carriage carrying the block holding elements of the movable grate block rows, the grate trough comprising: two side walls extending in a longitudinal direction of the grate; and a front and a rear frontal wall, the frontal walls being welded to the side walls so as to be at right angles to the side walls, the side walls and the frontal walls having projections and recesses which engage one into one another, the projections and recesses being provided in an edge of each wall so that projections of one wall project laterally into the recesses of another wall arranged at right angles so as to in each case bear with a side face on a bottom face of the corresponding recess.

3. A grate trough as defined in claim 2, wherein the projections of one wall have faces which are arranged transversely to a run of the wall edge and with which the projections come to bear on corresponding faces of the recesses of the other wall.

4. A grate trough as defined in claim 2, wherein the side walls have groovelike recesses which are distributed uniformly over a length of the side walls and are provided for direct reception of the block holding elements, parallel to the frontal walls, for the fixed grate block rows.

5. A grate, comprising a plurality of grate elements, each of the grate elements including a plurality of fixed and a plurality of movable grate block rows which are arranged so as to follow one another alternately and which are formed in each case from a plurality of grate blocks suspended next to one another on a block holding element and connected firmly to one another; and a grate trough forming a carrying element for the block holding elements of the fixed grate block rows and support for a movable grate carriage carrying the block holding elements of the movable grate block rows, the grate trough comprising two side walls extending in a longitudinal direction of the grate, and a front and a rear frontal wall, the frontal walls being welded to the side walls so as to be at right angles to the side walls, the side walls and the frontal walls having projections and recesses which engage one into one another, the frontal walls of grate troughs of adjacent grate elements being connected firmly to one another, the projections and recesses are provided in an edge of each wall so that projections of one wall project laterally into the recesses of another wall arranged at right angles so as to in each case bear with a side face on a bottom face of the corresponding recess.

* * * * *